US005512129A

United States Patent [19]

Brodalla et al.

[11] Patent Number: 5,512,129

[45] Date of Patent: Apr. 30, 1996

[54] METHOD FOR REGENERATING ALKALINE SOLUTIONS FOR PICKLING ALUMINUM

[75] Inventors: Dieter Brodalla, Düsseldorf, Germany; Roland Fransson, Aseda, Sweden; Herbert Breunig, Holzheim; Michael Ferner, Gundelfingen, both of Germany

[73] Assignee: Josef Gartner & Co., Germany

[21] Appl. No.: 292,930

[22] Filed: Aug. 18, 1994

Related U.S. Application Data

[63] Continuation of Ser. No. 927,670, Sep. 2, 1992, abandoned.

[30] Foreign Application Priority Data

Mar. 15, 1990 [DE] Germany ..... 40 08 379.9

[51] Int. Cl.[6] ..... B44C 1/22; C23F 1/00

[52] U.S. Cl. ..... 134/2; 252/79.5; 156/642.1

[58] Field of Search ..... 423/122, 124; 156/642, 642.1; 210/181, 182, 712, 713, 737; 252/79.5; 134/2

[56] References Cited

U.S. PATENT DOCUMENTS

| | | | |
|---|---|---|---|
| 2,739,883 | 3/1956 | Newman | 252/79.5 |
| 2,975,041 | 3/1961 | Holman | 41/42 |
| 3,481,877 | 12/1969 | Moll | 252/79.5 |
| 3,712,838 | 1/1973 | Weissenberg | 252/79.5 |
| 3,802,973 | 4/1974 | Smith | 156/651 |
| 3,810,797 | 5/1974 | Schaffstall et al. | 252/79.5 |
| 3,909,405 | 9/1975 | Aoyama | 210/46 |
| 4,136,026 | 1/1979 | Meyer et al. | 210/45 |
| 4,350,597 | 9/1982 | Selm et al. | 134/13 |
| 4,372,805 | 2/1983 | Takahashi et al. | 156/642 |
| 4,477,290 | 10/1984 | Carroll et al. | 134/2 |
| 4,663,145 | 5/1987 | Van den Berk et al. | 156/642 |
| 4,762,638 | 8/1988 | Dollman et al. | 134/2 |
| 4,826,605 | 5/1989 | Doble et al. | 210/721 |
| 5,091,046 | 2/1992 | Hunter et al. | 156/642 |

FOREIGN PATENT DOCUMENTS

| | | | |
|---|---|---|---|
| 0157190 | 3/1986 | European Pat. Off. . | |
| 2167243 | 8/1973 | France | 156/642 |
| 43977 | 8/1888 | Germany . | |
| 2850694 | 6/1979 | Germany . | |
| 3426114 | 9/1985 | Germany | 156/642 |
| 142433 | 11/1973 | Japan . | |
| 0104735 | 8/1975 | Japan | 156/642 |
| 0140241 | 12/1978 | Japan | 156/642 |
| 0014585 | 6/1979 | Japan | 156/642 |
| 0008587 | 3/1980 | Japan | 156/642 |

*Primary Examiner*—Steven Bos
*Attorney, Agent, or Firm*—Eckert Seamans Cherin & Mellott

[57] ABSTRACT

A method for regenerating alkaline solutions for pickling aluminum is provided, by which aluminum hydroxide is recovered. A pickling solution containing aluminum hydroxide, aluminate and a complexing agent and further additives is transferred from a pickling bath into a reactor section, which consists of at least one reactor where aluminum is precipitated as aluminum hydroxide. The pickling bath has a higher temperature than the reactor section. The process is operated so that the concentration of aluminate, alkali and gluconate as well as the temperature in the pickling bath, on the one hand, and the temperature gradient from the pickling bath to the reactor section, on the other hand, are adjusted so that the pickling solution in the pickling bath is undersaturated or metastably supersaturated with respect to precipitation of aluminum hydroxide, however, unstably supersaturated in the reactor section. A device for carrying out the process of the invention is also disclosed.

14 Claims, 1 Drawing Sheet

METHOD FOR REGENERATING ALKALINE SOLUTIONS FOR PICKLING ALUMINUM

This is a continuation of U.S. patent application Ser. No. 07/927,670, filed on Sep. 2, 1992, now abandoned.

BACKGROUND OF THE INVENTION

1. Field of the Invention

The invention relates to a method for regenerating alkaline solutions for pickling aluminum to recover aluminum hydroxide as well as to an apparatus for carrying out the method.

When aluminum surfaces are refined (e.g. anodic oxidation or plating), it is generally necessary to first subject these surfaces to a pickling or caustic treatment, where both acidic and basic pickling solutions can be employed. For alkaline pickling solutions, the aluminum is submersed into a heated bath, for example containing soda lye and is left there for a certain time. The pickling process consists of partially dissolving the metal surface by the lye, where small amounts of aluminum go into solution with the formation of hydrogen. The following total reaction takes place $$Al+NaOH+H_2O \rightarrow NaAlO_2+3/2\ H_2 \quad (1)$$

Since a certain amount of aluminum dissolves, the concentration of aluminate increases continuously in the bath during operation. Disposal of pickling solutions containing larger amounts of aluminate represents both an ecological and also an economic problem. Up until now, these solutions were neutralized using large amounts of acid (which in some cases are available from eloxal baths). More recently however several attempts have been made to recover the aluminum contained in the pickling solution, where one precipitates it as aluminum hydroxide and reuses it as raw material. This saves the purchase costs of aluminum hydroxide recovered in crystalline form and at the same time avoids greater environmental problems, for example resulting from the disposal of the normally amorphous aluminum hydroxide sludge. Furthermore, when precipitating the aluminum hydroxide in stoichiometric ratio, the base used in the pickling bath is recovered:

$$NaAlO_2+2\ H_2O \rightarrow Al(OH)_3+NaOH \quad (2)$$

The reuse of the base in the pickling bath, set free during the precipitation process, results in a further cost advantage and a further reduction of environmental load, because a less highly alkaline waste water arises, which must be neutralized and purified, whereby a salt is formed.

A method is therefore desirable by which the sodium aluminate is continuously converted by precipitation to aluminum hydroxide and the resulting base is continuously reused in the pickling bath by means of recycling. Such a method would only consume water altogether and according to the following total equation, would convert aluminum into aluminum hydroxide while releasing hydrogen:

$$Al+3H_2O \rightarrow Al(OH)_3+3/2\ H_2 \quad (3)$$

2. Description of the Related Art

Methods for recovering aluminum from alkaline pickling solutions in the form of aluminum hydroxide are known.

The German Patent DE-PS 43 977 discloses a method for treatment of hydrated alumina and alkali aluminate, by which aluminum hydroxide is precipitated by inoculation from a substantially pure alkali aluminate solution. This method was subject to later improvements, where however the improvements also used substantially pure aluminate solutions.

Modern aluminum pickling processes however do not work with pure alkali solutions, but have additives in the pickling solution which give the pickled aluminum surface a particular or desired optical appearance. Such additives are for example nitrate and nitrite. Today's pickling solutions also contain complexing agents mostly in the form of sorbitol, sometimes also gluconate. The additives provide that aluminum in the pickling bath is maintained as far as possible complexed in solution and does not prematurely precipitate as aluminum hydroxide. Such pickling solutions containing the above mentioned additives apart from aluminate are not suited for treatment with the above mentioned method of DE-PS 43 977 or the improvements deriving from this method.

EP-A1 157 190 discloses a method for precipitating aluminum hydroxide from pickling baths, which apart from aluminate also contain additives in the form of gluconate and carbonate. The precipitation of aluminum hydroxide in this method however takes place directly in the pickling bath. Such a procedure has drawbacks for various reasons. First of all, it cannot be prevented that the precipitated aluminum hydroxide does not deposit on the aluminum pieces to be pickled, which leads to undesired spot formation on the aluminum surface. In addition, it is necessary to filter out the precipitated aluminum hydroxide either continuously or batch-wise from the pickling solution.

The U.S. patent, U.S. Pat. No. 4,826,605 discloses the precipitation of aluminum hydroxide from pickling solution by the addition of acids and subsequent oxidation with ozone.

The object of the invention is to provide an improved method of the above mentioned type, by which the precipitation of aluminum hydroxide does not take place in the pickling bath and which enables inexpensive recovery of the aluminum hydroxide and also the base arising during precipitation by simple technical means.

SUMMARY OF THE INVENTION

Figure 1:
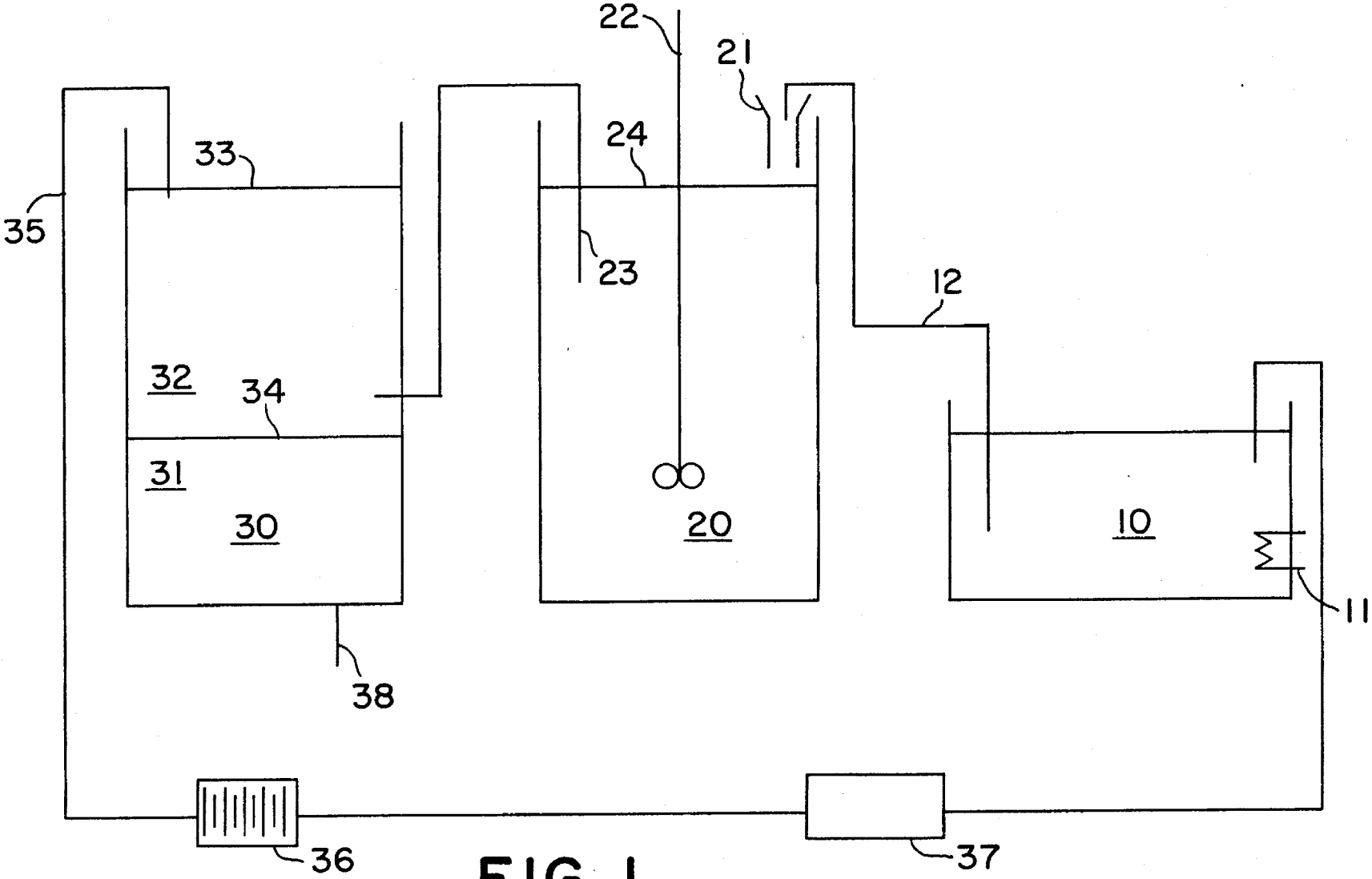
FIG. 1 shows an embodiment of an apparatus which is suited for carrying out the method of the present invention.

In accordance with the present invention, a method is provided for regenerating alkaline solutions for pickling aluminum to recover aluminum hydroxide, comprising transferring a pickling solution containing an aluminum hydroxide, aluminate as well as a complexing agent and further additives by means of a first transfer section from a pickling bath into a reactor section consisting of at least one reactor and precipitating aluminum there as aluminum hydroxide characterized in that a) the pickling solution in the pickling bath is at a higher temperature than the reactor section, b) the concentration of aluminate, alkali and complexing agent is adjusted, c) the temperature of the pickling solution in the pickling bath is adjusted, and d) the temperature gradient of the pickling solution from the pickling bath to the reactor section is adjusted, so that the picking solution in the pickling bath with respect to the precipitation of aluminum hydroxide is undersaturated or metastably supersaturated, and in the reactor section, however, is unstably supersaturated. Also provided is an apparatus for carrying out the method described above comprising a pickling bath comprising a pickling solution and a first transfer section for transferring the pickling solution into a reactor section consisting of at least one reactor, characterized by a heating and/or cooling means with which the pickling solution in the pickling bath is heatable to a temperature of 40° to 90° C., so that the pickling solution is held at a temperature in the range of 5° to 70° C. higher than in the reactor section.

DESCRIPTION OF THE PREFERRED EMBODIMENTS OF THE INVENTION

1. The method 1.1 The solution in the pickling bath

In accordance with the invention, the pickling solution in the bath must be undersaturated or metastably supersaturated, which is adjusted by the concentration of aluminate, alkali and gluconate in the pickling bath as well as the temperature as the control parameters. Preferred is an operation with slightly metastable supersaturation. The aluminate concentration (given as equivalents of aluminum) is 30 to 60 g/l, preferably 30 to 45 g/l. The concentration of the complexing agent, given as equivalents of gluconate, is 0.1 to 5 g/l, preferably 0.5 to 2 g/l. The alkali hydroxide concentration is in the range of 30 to 60 g/l equivalents of sodium hydroxide, preferably in the range of 45 to 55 g/l. The term "alkali hydroxide concentration" is to be understood as the free concentration of MeOH, where Me is an alkali metal. Methods exist for measuring the above mentioned concentration which are known and available to the persons in this art. Examples of this are found under Section 1.3 of the present specification. The temperature of the pickling bath lies in the range of 40° to 90° C., preferable in the range of 45° to 55° C. Heating of the pickling solution is normally necessary to maintain the temperature, in particular for low loads of the pickling bath. A lower load is understood as a less amount of aluminum per unit time to be converted to $NaAlO_2$. At higher loads however heating can possibly be relinquished, because the exothermic reaction according to Equation (1) itself delivers enough energy. For very high loads it may be possible that a cooling of the pickling solution is necessary.

It has been found surprisingly that under these conditions in the pickling bath, no precipitation of aluminum hydroxide takes place, although relatively high aluminum concentrations are present at relatively low concentrations of the complexing agent (gluconate). For this reason, a working procedure is preferred at high aluminum concentrations compared to the sodium concentration.

The pickling solutions in accordance with the invention contain mainly an alkali hydroxide (e.g. NaOH, KOH or mixtures thereof), aluminum (as aluminate) and the complexing agent. In addition additives such as nitrate and/or nitrite are included to improve the decorative surface finish. The nitrate concentrations are preferably in the range of 5 to 30 g/l, more preferably in the range of 20 to 25 g/l. Preferred nitrite concentrations are in the range of 5 to 30 g/l, more preferably in the range of 10 to 25 g/l. Further suitable additives include alkali salts of inorganic acids in a concentration range of 1 to 100 g/l, for example chloride, chlorate, carbonate and thiosulfate.

Gluconate is the most preferred complexing agent. The use of sorbitol, other complexing sugar derivatives, phosponates as well as polymers or oligomers of acrylates, however, are also possible.

1.2 Transfer of the pickling solution from the pickling bath to the reactor section The transfer of the solution from the pickling bath to the reactor section must take place so that precipitation of aluminum hydroxide is avoided as far as possible in the first transfer section, because this can lead to clogging in the first transfer section, when only small amounts of complexing agent are present, also to so called "mineralization". For this reason, it is preferred to substantially maintain the temperature of the pickling bath in the first transfer section. This can be achieved for example through heat insulation. However, it is also possible to employ an additional heater in the first transfer section.

The introduction of the pickling solution from the first transfer section to the reactor section preferably takes place without direct contact. This procedure is understood in that the pickling solution leaves the first transfer section and enters into the reactor section substantially in free fall, preferably through an intermediate funnel. In this manner crystallization grains present in the reactor section are prevented from penetrating into the first transfer section against the flow direction of the pickling solution and initiating crystallization there.

A reversed procedure is however also possible, by which the mineralization is prevented by intentionally causing a crystallization in the first transfer section, so that aluminum hydroxide is produced in fine distribution, which does not grow to larger aggregates and therefore does not lead to mineralization. This can be achieved for example by inoculating the reaction solution in the first transfer section. In this case, however, care must be taken, for example also through contactless transfer, that the crystallization grains introduced into the first transfer section do not enter into the pickling bath.

1.3 The pickling solution in the reactor section

In accordance with the invention, the pickling solution is transferred from the pickling bath by means of the first transfer section into a reactor section consisting of at least one reactor. In the following, the pickling solution transferred to the reactor section is referred to as the "reactor solution".

The precipitation of aluminum as aluminum hydroxide takes place in the reactor section by the creation of conditions under which the reactor solution is instably supersaturated. For this purpose, a temperature jump between the pickling bath and the reactor section is provided. As already stated, the solution in the pickling bath has a temperature of 40° to 90° C., so that the reactor section must be held at a lower temperature. According to the invention, a temperature jump or optimal temperature gradient between the pickling bath and the reactor section represents a temperature difference in the range of 5° to 70° C., preferably 10° to 40° C.

If one selects the temperature of the reactor solution to be too low (seen absolutely), this can lead to poor crystallization due to delayed grain formation. According to present knowledge, this is related to the fact that both the grain formation and also the growth of aluminum hydroxide on existing grains are subject to a diffusion control and are therefore temperature dependant. If one selects the temperature of the reactor solution to be too low, the aluminum hydroxide present in the solution cannot reach the grain (or possibly only at very low rate) and then grow to larger aggregates capable of precipitation.

In a preferred embodiment of the method according to the present invention, the precipitation in the reactor section is enhanced and accelerated by inoculation. "Inoculation" is understood in the following as the presence of crystal grains. The introduction of grains externally is generally only necessary when starting up the equipment. When the equipment has been in operation for a certain time (about 24 to 72 hours), a sufficient grain density in the sense of a stationary equilibrium arises in the reactor solution. Crystalline aluminum hydroxide arising during precipitation also acts further as grains, i.e. the method in this respect is self-initiating. The method however can also be operated in that grains are continuously introduced from the outside, when the equilibrium state of the grain density is not sufficient. A suitable inoculation agent to be introduced externally can be crystalline aluminum hydroxide materials, preferred is gibbsite. It has been observed that aluminum hydroxide precipitates out substantially also as gibbsite when gibbsite is introduced as the inoculating agent.

The amount of inoculating agent is preferably in the range of 5 to 500 ml, more preferably 50 to 250 ml/l gibbsite slurry per liter of reactor solution. Precipitation rates of up to 30 g aluminum per liter and day have been achieved.

A high contact density between inoculating agent or grains and the fluid is necessary for crystal growth both in the start-up phase and in the later stationary phase. For this reason, the reactor section is preferably stirred intensively, where with a reactor section comprising several reactors it can be advantageous only to stir the first reactor and operate the following reactor or reactors without stirring. In such a case, the first reactor will be referred to as the reaction vessel and the following reactors will be referred to as sedimentation vessels.

The method in accordance with the invention is preferably carried out with one reaction vessel and at least one following sedimentation vessel. The reaction vessel serves substantially only for grain formation and the sedimentation vessel for settling-out of the formed aluminum hydroxide crystals. In the unstirred sedimentation vessel, the crystals form a sedimentation layer which is topped by a strongly alkaline aqueous solution. Very generally, the basic concentration and therefore the pH value increases from the pickling bath to the reaction vessel and then to the sedimentation vessel, because of the base reformed during precipitation of aluminum hydroxide according to Equation (2).

When pickling with the additives nitrite and nitrate, these are reduced by aluminum to ammonia. With the high alkali concentration of the method, the ammonia is gassed off and is recognizable by its odor. Equivalent amounts of alkali hydroxide are formed from the additives nitrite and nitrate.

The transfer of the reactor solution from the reaction vessel to the sedimentation vessel takes place such that the reactor solution is introduced into the sedimentation vessel below the liquid surface, however above the phase boundary of the sedimentation layer. This can be provided for example by a side opening in the wall of the sedimentation vessel.

In the above described embodiment, the precipitated aluminum hydroxide is recovered by removal of the sedimentation layer from the sedimentation vessel, optionally washed neutrally with water and dried and can be used further.

The base arising when precipitating aluminum hydroxide can be recovered by removing the aqueous, highly alkaline solution, which appears in the sedimentation vessel above the phase boundary sediment/liquid. It is preferred that this alkaline solution be returned to the pickling bath and reused for pickling aluminum (recycling). The removed alkaline solution should contain no or the fewest possible crystallization grains, because these could lead to undesired crystal growth of aluminum hydroxide in the pickling bath. The alkaline solution is therefore preferably withdrawn from the surface of the liquid in the sedimentation vessel and filtered before returning to the pickling bath. Alternatively, further sedimentation vessels could be employed after the (first) sedimentation vessel. A combination of both features (filtration plus additional sedimentation vessels) is also possible.

The reaction vessel can be designed in one, two or more stages. A multi-step procedure is necessary when post-reactions occur.

In summary the best and most preferred embodiment of the method according to the present invention is characterized by the following operational parameters:

The pickling solution in the pickling bath should be metastably supersaturated with respect to precipitation of aluminum hydroxide and be slightly below the temperature stability limit; it should however not yet be in the region of grain formation;

the pickling solution should contain the complexing agent in an amount which delays grain formation but does not retard crystal growth;

the temperature of the bath and at least the first reactor (reaction vessel) should have a temperature difference of about 10° to 40° C., preferably a preselected and optimized temperature gradient;

a high grain density should be present in the reaction zone, at least in the reaction vessel, i.e. a high number of grains compared to the solution;

a settling out of aluminum hydroxide formed in the reaction vessel should take place in at least one sedimentation vessel, where generally a post-reaction takes place in the sedimentation vessel;

the recovered base is withdrawn as a highly alkaline solution near the liquid surface of the sedimentation vessel and returned after filtration to the pickling bath (recycling), where intermediate provision of a further sedimentation vessel is possible.

The maintenance of the concentrations of aluminate, alkali hydroxide and complexing agent within the above given ranges can be monitored by analytic measurements of these concentration values either continuously or in regular time intervals. Direct or indirect methods are suitable for the measurement. For example, aluminum can be directly determined photometrically by means of a color reaction, however, it can also be determined indirectly in alkaline media by complexing aluminum with fluoride and acidimetrically determining the base released by complex formation. In this procedure, aluminum can be determined also apart from alkali hydroxide. For organic complexing agents, for example gluconate, the CSB measurement or another oxidative procedure is suitable as an indirect method, by which the organic carbon is also oxidized to $CO_2$. In addition, measurements can be used which provide a bulk parameter, for example the measurement of the electrolytic conductivity. The following analytic analysis methods are particularly preferred:

a) Alkalihydroxide and aluminum

An aliquot portion of the pickling solution is titrated to a pH value of 8.2 with a HCl solution of known normality. Based on the corresponding stoichiometric calculation, the concentration of the free alkali hydroxide results from the amount of HCl consumed. After adding an excess of alkali fluoride to the so-titrated solution, the hydroxide groups bound to the aluminum are released. A second titration to a pH value of 8.2 allows an indirect indication of the stoichiometric equivalent aluminum concentration. The monitoring of pH value with the two titrations takes place preferably not with a color indicator, but potentiometric using a glass electrode, most preferably with a single measuring chain.

b) Equivalent gluconate

In an aliquot portion of the pickling solution, possibly present nitrate is initially removed through addition of an excess of urea which forms nitrogen gas. This is followed by a redox titration with potentiometric end point determination in a sulfuric acid solution at about 70° C. with a cerium(IV) solution of known normality as the oxidation agent. The measurement is more accurate for example when an excess of the cerium(IV) solution is prepared and then a back titration takes place with potentiometric determination of the end point by means of an iron (II) salt solution of determined normality.

c) Gluconate equivalent complexing agent

For the amount of gluconate equivalent complexing agent, the complex forming activity is initially determined experimentally by determining what aluminum concentration can be held in solution, when other experimental parameters are held constant in comparison to gluconate. The so-determined concentration is iteratively checked at the same aluminum concentration and under otherwise constant experimental parameters, compared to the given gluconate concentration. The ratio of the molecular or equivalent weights and the determined factor of complex formation activity are then incorporated into the concentration calculation. The specific analysis methods known in the literature for phosphonates are used to determine its concentration.

2. The apparatus

The apparatus in accordance with the present invention comprises a pickling bath in which the pickling solution is heatable or possibly coolable to the temperatures as previously described. A first transfer section leads from the pickling bath to a reactor section consisting of at least one reactor. The first transfer section is represented for example by a pipe line and is preferably insulated against heat loss and/or can be heated.

The connection between the transfer section and the reactor section is preferably provided so that the transfer pipe is not submersed (contactless transfer) into the liquid level of the reactor section. Preferably, the transfer section terminates directly above a funnel-like inlet element, which is arranged above the liquid level of the first reactor.

The reactor section consists of at least one reactor, where an arrangement consisting of a first stirred reactor (reaction vessel) and a following unstirred sedimentation vessel is preferred. However, a further stirred reaction vessel can be arranged between the (first) reaction vessel and the sedimentation vessel. The volume of the reaction vessel is preferably ⅓ to ½ the volume of the pickling bath. The reactor volume represents an additional control parameter for the method, because the retention time of the reactor solution in the reactor can be therewith adjusted. A retention time of 36 to 60 hours is preferred. In addition, the reactor volume stabilizes the temperature of the reactor contents. The reaction vessel comprises a stirring means, with which the contents can be vigorously stirred. The reaction vessel is preferably tall and as slim as possible, thus enabling a simple and effective stirring and also improving the subsequent sedimentation.

A second transfer section leads from the reaction vessel to the sedimentation vessel. The second transfer section enters the sedimentation vessel preferably via a side wall opening at a level just above the phase separation between sediment and liquid.

The sedimentation vessel has a volume similar to that of the reaction vessel and can comprise a third transfer section, with which the clear alkaline solution above the sediment can be drawn off as close as possible to the liquid surface of the sedimentation vessel. It is preferred that this transfer section feeds back to the pickling bath (recycling), where a filter is provided therebetween.

The invention will be described further in the following with reference to the drawings.

FIG. 1 shows an embodiment of an apparatus in accordance with the invention comprising a pickling bath 10, which is equipped with a heating and/or cooling means 11. A first transfer section 12 extends from the pickling bath 10, which is configured to be heat insulated or can be heated. The transfer section joins into the reaction vessel 20 via a funnel-shaped inlet arrangement 21, which is provided with stirring means 22. The stirring means 22 can also be arranged at an angle of about 45° through a side wall of the reaction vessel 20. The reaction solution with the liquid level 24 stands in the reaction vessel 20.

The removal of liquid from the reaction vessel 20 takes place via a second transfer section 23. The second transfer section 23 joins into a sedimentation vessel 30 through a side wall port just above the phase separation 34, which is formed between the liquid 32 and the sediment 31. The contents of the sedimentation vessel 30 have a liquid level 33, where a third transfer section 35 for discharge of the clear liquid 32 is provided directly at the level of or at the most slightly under the liquid level 33. The third transfer section 35 leads back to the pickling bath 10, where a filter 36 and preferably a measurement means 37 is provided intermediately. A discharge point for aluminum hydroxide is designated 38.

The supply of the media is provided with conventional pumps. A second reaction vessel for alternative operation can be arranged parallel to the reaction vessel 20 shown in the figure.

In the embodiment shown here, the pickling bath 10 has a volume of about 10 $m^3$ and the reaction and sedimentation vessels 30 have a volume of about 8 $m^3$ respectively.

EXAMPLE 1

An example for the application of the method according to the invention is represented by the measurement record for the operation of the apparatus in the time from Mar. 1 to Mar. 7, 1990, where Reactor I refers to reaction vessel 20 and Reactor II refers to the sedimentation vessel 30. The concentrations of NaOH and aluminum in the pickling bath (pickling solution) are 43.4 to 56.0 g/l and 33.2 to 40.5 g/l respectively, while the concentration of gluconate is 0.9 to 1.2 g/l. Although relatively little complexing agent was added, no precipitation of aluminum hydroxide in the pickling bath was observed.

Measurement Record

| Month March 90 Date | Pickling Solution NaOH g/l | Al g/l | Nitrite g/l | Nitrate g/l | Gluc. g/l | Conductivity ms/cm | Feed from Reactor NaOH g/l | Al g/l | Nitrite g/l | Nitrate g/l | Gluc. g/l | Conductivity ms/cm | Refreshing Amounts NaOH l | Nitrite kg | Nitrate kg | Gluc. kg | Feed to reactor cbm/day | Reflux from react. cbm/day | Pickling throughput cm |
|---|---|---|---|---|---|---|---|---|---|---|---|---|---|---|---|---|---|---|---|
| 01. | 48.3 | 34.0 | 23.9 | 24.9 | 1.1 | 115.5 | | | | | | | 112 | 50 | 25 | 0 | 0.66 | 0.16 | 315 |
| 02. | 56.0 | 33.2 | 23.6 | 25.4 | 1.2 | 126.7 | 69.7 | 25.1 | 21.6 | 25.0 | 0.8 | 167.4 | 0 | 0 | 0 | 0 | 1.02 | 1.02 | 540 |
| 03. | | | | | | | | | | | | | | | | | 1.18 | 1.18 | |
| 04. | | | | | | | | | | | | | | | | | 1.18 | 1.18 | |
| 05. | 54.3 | 35.5 | 17.9 | 21.0 | 1.2 | 121.5 | 58.8 | 30.8 | 24.3 | 22.7 | 0.9 | 134.9 | 0 | 75 | 50 | 0 | 1.18 | 1.18 | 450 |
| 06. | 49.7 | 40.2 | 18.1 | 23.0 | 0.9 | 106.7 | 54.5 | 32.9 | 21.6 | 23.4 | 0.8 | 135.9 | 0 | 125 | 25 | 2 | 1.08 | 1.08 | 720 |
| 07. | 43.4 | 40.5 | 19.2 | 21.4 | 0.9 | 110.0 | 57.2 | 33.9 | 20.5 | 22.7 | 0.8 | 135.7 | 112 | 125 | 50 | 1 | 0.94 | 0.84 | |
| 08. | | | | | | | | | | | | | | | | | | | |
| 09. | | | | | | | | | | | | | | | | | | | |
| 10. | | | | | | | | | | | | | | | | | | | |
| 11. | | | | | | | | | | | | | | | | | | | |
| 12. | | | | | | | | | | | | | | | | | | | |
| 13. | | | | | | | | | | | | | | | | | | | |
| 14. | | | | | | | | | | | | | | | | | | | |
| 15. | | | | | | | | | | | | | | | | | | | |
| 16. | | | | | | | | | | | | | | | | | | | |

| Month March 90 Date | Reactor I NaOH g/l | Al g/l | Conductivity mS/cm | Sediment ml/l | Feed from pickl. sol. cbm/day | Removed crystals cbm | Reactor II NaOH g/l | Al g/l | Conductivity mS/cm | Sediment ml/l | Feed from pickl. sol. cbm/day | Removed crystals cbm | Remarks R I | II |
|---|---|---|---|---|---|---|---|---|---|---|---|---|---|---|
| 01. | 58.5 | 28.5 | 140.5 | 50 | 0.66 | 0 | 62.5 | 28.7 | 148.0 | 0 | 0.66 | 0 | Stirrer, Reactor I shut down repaired | |
| 02. | 57.9 | 31.2 | 136.7 | 40 | 1.02 | 0 | 58.4 | 30.8 | 139.3 | 0 | 1.02 | 0 | | |
| 03. | | | | | 1.18 | | | | | | 1.18 | | | |
| 04. | | | | | 1.18 | | | | | | 1.18 | | | |
| 05. | 54.0 | 32.8 | 123.3 | 50 | 1.18 | 0 | 59.4 | 32.7 | 124.4 | 0 | 1.18 | 0 | Stirrer, Reactor I stopped on the weekend | |
| 06. | 56.5 | 34.2 | 127.0 | 20 | 1.08 | 0 | 57.9 | 34.5 | 126.2 | 0 | 1.08 | 0 | | |
| 07. | 53.4 | 37.7 | 119.2 | 20 | 0.94 | 0 | 53.6 | 35.8 | 127.7 | 0 | 0.94 | 0.10 | 30 cm pickling bath lost, stirrer defect in the morning | |
| 08. | | | | | | | | | | | | | | |
| 09. | | | | | | | | | | | | | | |
| 10. | | | | | | | | | | | | | | |
| 11. | | | | | | | | | | | | | | |
| 12. | | | | | | | | | | | | | | |
| 13. | | | | | | | | | | | | | | |
| 14. | | | | | | | | | | | | | | |

-continued

| Measurement Record |
| --- |
| 15. |
| 16. |

We claim:

1. A method for regenerating alkaline solutions for pickling aluminum to recover aluminum hydroxide, comprising:

a) providing an aqueous pickling solution for pickling aluminum comprising alkali hydroxide and a complexing agent in a pickling bath;

b) contacting the pickling solution with aluminum to be pickled, so that aluminum is dissolved in the pickling solution as aluminate;

c) adjusting the concentration of aluminate, alkali hydroxide, and complexing agent in the pickling solution to maintain a concentration of about 30 to 60 g/l aluminate given as equivalents of Al, about 30 to 60 g/l alkali hydroxide given as equivalents of sodium hydroxide, and about 0.1 to 5 g/l complexing agent given as gluconate or equivalents of gluconate, and adjusting the temperature of the pickling solution in the pickling bath to maintain the temperature of the pickling solution between 40° to 90° C., so that the pickling solution in the pickling bath with respect to precipitation of aluminum as aluminum hydroxide is undersaturated or metastably supersaturated;

d) transferring the pickling solution from the pickling bath to a reactor section, defining an aqueous reactor solution, for precipitating aluminum as aluminum hydroxide from said reactor solution;

e) cooling the reactor solution by about 5° to 70° C. so that the reactor solution in the reactor section with respect to precipitation of aluminum as aluminum hydroxide is unstably supersaturated;

f) precipitating aluminum as aluminum hydroxide from the reactor solution in the reactor section, thereby reforming alkali hydroxide; and, g) recovering the aluminum hydroxide and the reformed alkali hydroxide.

2. The method of claim 1, wherein the complexing agent is selected from the group consisting of gluconate, sorbitol, phosphonate, a polymer of acrylate and an oligomer of acrylate.

3. The method of claim 1, wherein the alkali hydroxide is selected from the group consisting of sodium hydroxide and potassium hydroxide and mixtures thereof.

4. The method of claim 1, wherein the pickling solution further comprises additives selected from the group consisting of nitrate, nitrite, and alkali salt of inorganic acid.

5. The method of claim 1, wherein said precipitating step f) further comprises inoculating the reactor solution with crystal grains of seed aluminum hydroxide crystals to increase a grain density of said aluminum hydroxide crystals, so that precipitation of aluminum hydroxide is enhanced or accelerated.

6. The method of claim 5, wherein the reactor solution is inoculated with gibbsite and has a concentration of about 5 to 500 ml/l gibbsite slurry per liter of reactor solution.

7. The method of claim 1, wherein step d) further comprises transferring the pickling solution to the reactor section by a contactless transfer so as to prevent crystallization grains present in the reactor section from initiating crystallization during the contactless transfer and from penetrating into the pickling bath and initiating crystallization in the pickling bath.

8. The method of claim 7, wherein the pickling solution is introduced to the reactor section in free fall.

9. The method of claim 1, wherein said transferring step d) further comprises heating or insulating from heat loss the pickling solution during transfer from the pickling bath to the reactor section, so that initiation of precipitation of aluminum hydroxide during transfer is avoided.

10. The method of claim 1, wherein said method further comprises:

h) recycling the reformed alkali hydroxide to the pickling bath in step c); and, i) repeating said contacting step b) through said recycling step h).

11. The method of claim 10, wherein the reformed alkali hydroxide is filtered before recycling to the pickling bath in said recycling step h).

12. The method of claim 1, wherein the method prior to step g) further comprises:

f.1) stirring and precipitating the reactor solution in the reactor section; and, f.2) transferring the stirred and precipitated reactor solution to a sedimentation vessel; and, f.3) forming a sedimentation layer separated from a reformed alkali hydroxide liquid layer by a phase boundary.

13. The method of claim 12, wherein step f.2) further comprises introducing the reactor solution to the sedimentation vessel below the liquid surface and above the phase boundary of the sedimentation layer.

14. The method of claim 13, wherein said recovering step g) further comprises recovering the alkali hydroxide from the reformed alkali hydroxide liquid layer above the phase boundary and recovering the aluminum hydroxide from the sedimentation layer below the phase boundary.

* * * * *